US010094059B2

(12) United States Patent
Wang et al.

(10) Patent No.: US 10,094,059 B2
(45) Date of Patent: Oct. 9, 2018

(54) GARMENT CLEANING APPLIANCE

(71) Applicant: KONINKLIJKE PHILIPS N.V., Eindhoven (NL)

(72) Inventors: Yanyan Wang, Eindhoven (NL); Yong Jiang, Eindhoven (NL); Mohankumar Valiyambath Krishnan, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 276 days.

(21) Appl. No.: 14/368,008

(22) PCT Filed: Dec. 21, 2012

(86) PCT No.: PCT/IB2012/057578
§ 371 (c)(1),
(2) Date: Jun. 23, 2014

(87) PCT Pub. No.: WO2013/098730
PCT Pub. Date: Jul. 4, 2013

(65) Prior Publication Data

US 2015/0000353 A1 Jan. 1, 2015

(30) Foreign Application Priority Data

Dec. 27, 2011 (EP) ..... 11195735

(51) Int. Cl.
*D06F 17/12* (2006.01)
*D06F 18/00* (2006.01)

(52) U.S. Cl.
CPC ..... *D06F 17/12* (2013.01); *D06F 18/00* (2013.01)

(58) Field of Classification Search
CPC ..... D06F 17/00–17/12; D06F 18/00
See application file for complete search history.

(56) References Cited

U.S. PATENT DOCUMENTS

| | | | | |
|---|---|---|---|---|
| 6,886,373 | B2 | 5/2005 | Carrubba | |
| 8,424,141 | B2 | 4/2013 | Yoo | |
| 2005/0150261 | A1* | 7/2005 | Carlucci | B08B 3/00 68/222 |
| 2006/0101867 | A1* | 5/2006 | Kleker | D06F 17/04 68/5 C |
| 2006/0277690 | A1* | 12/2006 | Pyo | D06F 25/00 8/149.2 |
| 2008/0252189 | A1* | 10/2008 | Regan | A47B 81/00 312/249.8 |
| 2010/0139334 | A1 | 6/2010 | Kim et al. | |

FOREIGN PATENT DOCUMENTS

| | | | |
|---|---|---|---|
| CN | 1464090 | | 12/2003 |
| CN | 101492875 | | 7/2009 |
| CN | 102108626 | A | 6/2011 |
| EP | 2107150 | A1 | 10/2009 |
| EP | 2213781 | A1 | 8/2010 |
| JP | 2007111238 | A | 5/2007 |
| JP | 2010131069 | A | 6/2010 |
| WO | 2004091359 | A2 | 10/2004 |
| WO | 2007051456 | A1 | 5/2007 |

* cited by examiner

*Primary Examiner* — Spencer E Bell

(57) ABSTRACT

A garment cleaning appliance comprises a housing (1) having a chamber (2) to receive garments to be cleaned, and a steam generator (6) for supplying steam to the chamber (2) to clean the garments in the chamber (2). The appliance also includes a condensing element (9) arranged to condense the steam such that condensate is directed onto the garments.

11 Claims, 3 Drawing Sheets

GARMENT CLEANING APPLIANCE

This application is the U.S. National Phase application under 35 U.S.C. § 371 of International Application No. PCT/IB2012/057578, filed on Dec. 21, 2012 which claims benefit of European Patent Application No. 11195735.3, filed Dec. 27, 2011. This application is hereby incorporated by reference herein.

FIELD OF THE INVENTION

This invention relates to an appliance for cleaning garments, and more specifically to an appliance for cleaning garments using steam.

BACKGROUND OF THE INVENTION

WO2007/051456 describes a cabinet-like apparatus for washing and drying laundry which is inserted in a suspended manner in a common treatment area. The apparatus has a device for disinfection and/or sterilization purposes, with which device the laundry which remains in the same position in the common treatment area after washing/drying is brought to temperatures which suffice for thermal disinfection and/or sterilization of the inserted laundry during and/or after drying over a sufficient period of time. The apparatus has has a smooth function, through which steam is brought into the treatment area to relax the tissue fibers of the laundry.

Thorough cleaning and sanitisation of clothes is especially important for babies and young children. However, conventional washing machines do not typically reach the temperatures required to effectively sanitise clothing, meaning bacteria may continue to grow on the garments. It is also important to ensure that the garments are properly rinsed so that no detergent residues, dirt or water impurities, for example scale particles, remain after washing. Any unwanted residue may cause discomfort or skin irritation, especially for young children.

SUMMARY OF THE INVENTION

The present invention seeks to provide an improved device for cleaning garments. The invention is defined by claim 1. The dependent claims define advantageous embodiments.

A garment cleaning appliance according to the present invention is characterised in that the rinsing means comprises a condensing element arranged to condense the steam such that condensate is directed onto the garments.

The advantage of rinsing the garments with water condensed from the steam in the chamber is that there is no requirement for an additional water feed, supply or pump to move water to the top of the chamber. Furthermore, condensed steam is pure water rather than tap water which normally contains scale. In this way, it will be more effective for rinsing garments to remove residues such as detergents. Also, the condensed steam will remain at a high temperature so is better for rinsing the garments because it will better dissolve any residues and dirt.

Preferably, the steam generator is positioned beneath the chamber, or at a lower portion of the chamber, such that steam is ejected into the chamber below, or at a lower portion of the garments in the chamber.

The steam generator may comprise a water tank and heater to heat the water to generate steam.

In a preferred embodiment, an ionizer may be positioned such that the steam generated by the steam generator is ionized by the ionizer before entering the chamber. Ionizing the steam particles prevents them from coalescing and forming larger steam particles—small steam particles are better for penetrating and sanitising fabrics.

The condensing element preferably comprises a metallic plate positioned such that one surface faces garments received in the chamber and such that it is exposed to steam in the chamber, the other surface being exposed to cool air such that the steam condenses on the plate and condensate is directed onto the garments in the chamber.

In a preferred embodiment, the garment cleaning appliance comprises a fan to blow air over said other surface of the metallic plate to expose said surface to cool air. Cooling the metallic plate will increase the effectiveness of the condensing element and increase the flow of rinse water onto the garments.

The fan may be located below the chamber and the housing includes a duct for the passage of air from the fan to the other surface of the metallic plate.

The metallic plate may have a corrugated or irregular shape to maximise its surface area upon which steam can condense.

Preferably, the corrugated metallic plate comprises a portion that is proximate to, or touching, the garments so that condensate is directed from the metallic plate onto the garments.

The fan may also be configured to blow air into the chamber via a heater to dry garments in the chamber after cleaning garments with steam and rinsing them with condensate. Bacterial growth on dry garments is known to be less than bacterial growth on wet or damp garments. Well dried garments are therefore preferable. In a preferred embodiment, the heated air has a temperature of 50° C. or higher. The speed of the drying process depends on the power of the fan and air temperature. In order to enable fast drying, some embodiments the air is heated to a temperature of 80° C. or even higher. In an embodiment the temperature of the air used for drying is user adjustable in order to allow the user to select the temperature most suitable for the garment being treated.

Preferably, the chamber includes an inlet for the passage of heated air into the chamber and an outlet for air that has passed through the chamber.

In a preferred embodiment the garment cleaning appliance comprises garment supports in the chamber to hang garments from, or attach garments to said garment supports in the chamber.

In another embodiment, the garment cleaning appliance may comprise a water feed and a heater for flooding the chamber with hot water prior to or after cleaning with steam.

These and other aspects of the invention will be apparent from and elucidated with reference to the embodiments described hereinafter.

BRIEF DESCRIPTION OF THE DRAWINGS

Preferred embodiments will now be described, by way of example only, with reference to the accompanying drawings in which.

DETAILED DESCRIPTION

Steam cleaning of garments overcomes many of the problems associated with cleaning garments with water. The advantages are that the high temperature of steam kills bacteria and can penetrate clothing to give a deeper clean and leave fabrics feeling soft.

Figure 1:
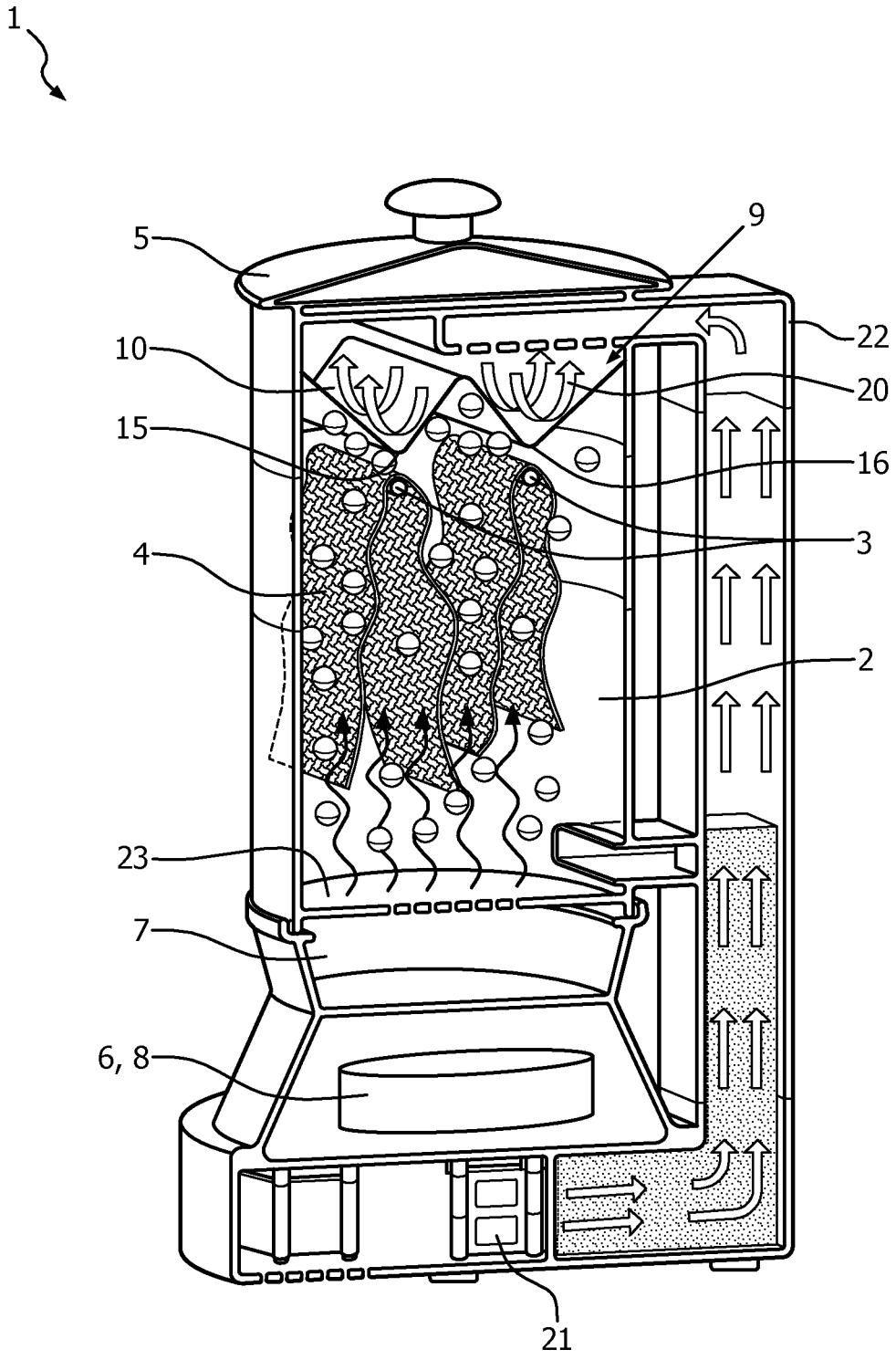
FIG. 1 shows a cross sectional view of a garment cleaning device during a steam cleaning and rinsing process.

Referring to the drawings, FIG. 1 shows a garment cleaning device having a housing 1 comprising a steam chamber 2 and hanger elements or supports 3 and a lid 5 positioned on the top of the chamber 2 for providing access and for sealing the chamber 2 during operation. The hanger elements 3 are rods that are mounted to the chamber 2 for hanging garments 4 within the chamber 2. The hanger elements 3 could comprise clips, or be designed such that ordinary clothes pegs can be attached to them, so that the garments can be anchored to the hanger elements 3.

The housing 1 also contains a steam generator 6 and a water storage tank 7. The steam generator 6 is positioned below the storage tank 7 and heats water from the storage tank 7 to generate steam. The storage tank 7 is refillable from a side opening, such as a spout (not shown). Steam naturally rises into the steam chamber 2 and interacts with the garments 4 to clean and sanitise them. The steam generator 6 may instead be located aside the chamber 2, at a lower portion of the chamber 2 so that the steam enters the chamber through the side in a lower portion of the chamber 2 (not shown).

A high energy discharge ionizer 8 is incorporated within the steam generator 6 to give the steam particles a charge. That charge is the same, either positive or negative, to prevent the particles from coalescing into larger molecules because smaller steam particles are better for penetrating fabrics and cleaning garments. The ionizer may directly ionize the steam particles or, more likely, may ionize an air stream which is subsequently mixed with the steam. Typically, the steaming process should last at least 10 minutes to ensure that the garments are fully sanitised. The materials used for the device should be able to withstand high temperature steam and water, in excess of 100° C.

The steam generator will produce scale as a by-product of evaporating water. This scale will be concentrated around the heating element in the steam generator and a small trap may be included to prevent the scale from moving to other parts of the device. A valve may be provided for draining water and scale from this trap to prevent the performance of the heating element from reducing as a result of scale build up.

During the steaming process it is advantageous to rinse the garments 4 with clean water to dissolve any detergent residue that has accumulated or any dirt that has been loosened by the steaming process. A sprinkler or pouring system positioned above the garments, with a water source, could provide a steady stream of water to rinse the garments of any residue or detergent. However, it is preferred to use pure water over tap water because it contains fewer impurities and will better dissolve the unwanted residues on the garments 4. Evaporated and condensed water is also free from microbiological impurities and therefore more hygienic for rinsing the garments. In order to provide a steady stream of pure water the cleaning device 1 comprises a condenser 9 to condense steam in the chamber 2 into water for rinsing the garments 4.

Rinse water is created by condensing steam at the top of the chamber 2 and letting it flow onto the garments 4 under the influence of gravity. The condensing element 9 is attached to the lid 5 and comprises a metallic plate 10 that covers the majority of the top of the chamber 2. FIG. 1 shows that the plate is corrugated so that it assumes a 'W' shape to increase its surface areas. The lower points 15, 16 of the plate 10 are positioned immediately above the hanger elements 3 so that the lower points 15 are proximate to or even touching the garments 4. When steam condenses on the plate 10, water will naturally flow to the lower points 15, 16 and flow or drip onto the garments 4, providing a flow of rinse water. A steady flow of rinse water depends on there being sufficient steam in the chamber 2 and on the plate 10 being at a low enough temperature to facilitate condensation. The air and steam immediately adjacent to the plate 10 on the chamber 2 side will be cooled because the plate 10 is metallic; cooling the steam causes water vapour and therefore condensation to form on the underside of the plate 10.

The plate 10 is cooled by a flow of cool fluid over its upper surface, on the opposite side to the steam chamber 2 to increase condensate formation on its lower surface. In this embodiment, the fluid is air and the flow of cool air is generated by an air fan 21 located in the bottom part of the cleaning device 1, below the chamber 2. The air flow 20 is directed through a conduit 22 to the area above the plate 10. An outlet is located either in the lid 5 or in a side wall of the chamber 2 so that air flows over the top of the plate 10 and out into the atmosphere to keep the plate 10 cool. The air fan may instead be located in other positions such as aside the chamber or even in the vicinity of the lid 5.

The rinse water will dissolve or wash away detergents and other dirt on the garments 4 and be collected by a waste water collection plate 23 at the bottom of the chamber 2. During the cleaning process, when the garments 4 are being simultaneously steamed and rinsed, the water that has been collected in the waste water collection tray 23 may be re-circulated into the steam cleaning process by re-evaporating the water. When the recycled water is evaporated it is purified, leaving the impurities that were dissolved from the garments in the waste water tray 23. The waste water tray 23 is removable and easily cleanable so that residues from evaporating the waste water can be easily washed away.

Figure 2:
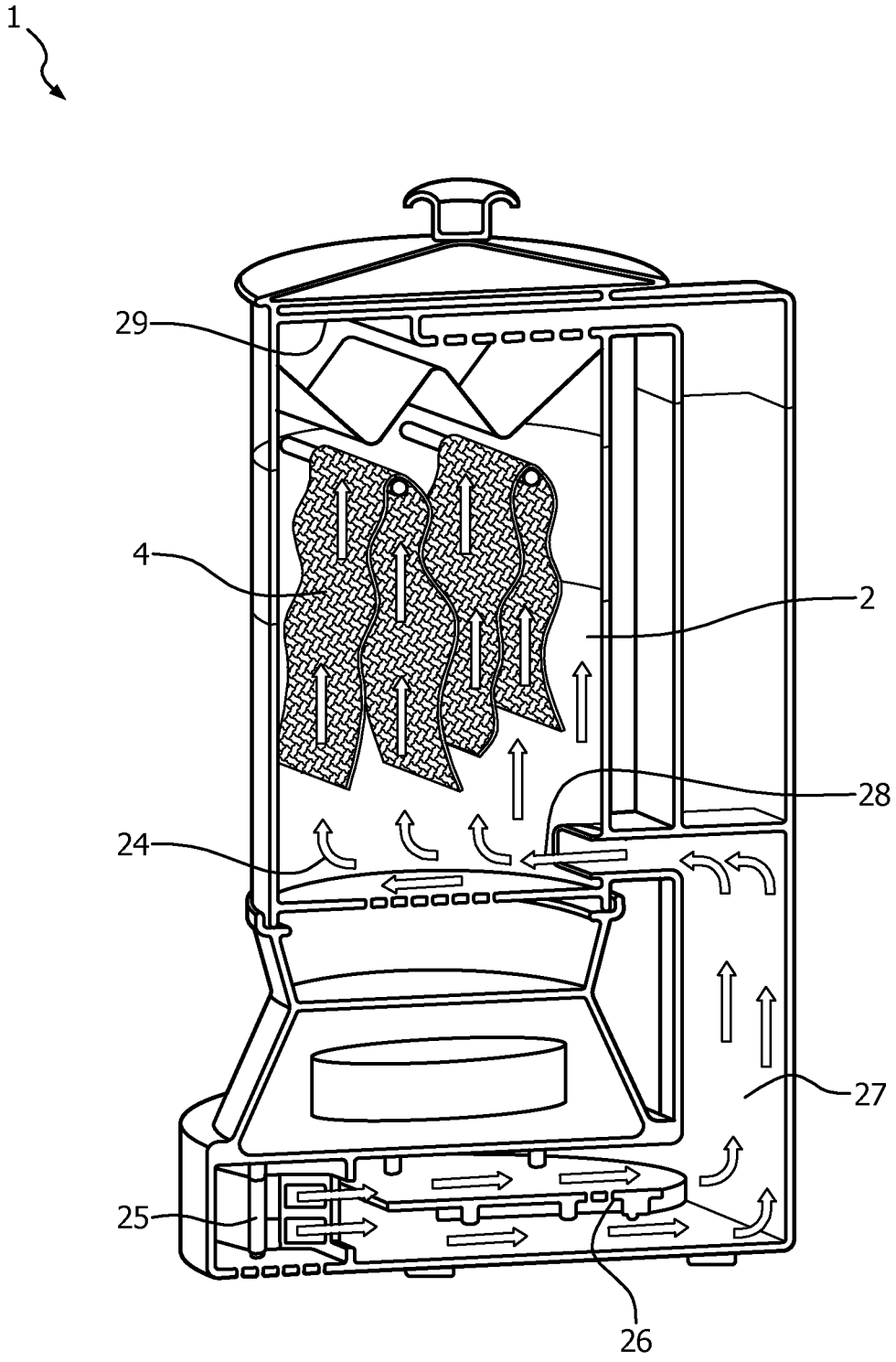
FIG. 2 shows a cross sectional view of the garment cleaning device of FIG. 1 during a drying process.

Following the steaming and rinsing processes the garments 4 are dried by circulating warm or hot air 24 through the chamber 2 as shown in FIG. 2. An air fan 25 and an air heater 26 are located in the base of the cleaning device 1 to provide hot air to the chamber 2 by means of another conduit 27. The air fan 25 may be the same as the condenser fan 21 or may be an additional fan. The chamber 2 comprises an air inlet 28 and an air outlet 29 for the drying air. The air inlet 28 is located at the bottom of the chamber 2 and the outlet 29 on the side wall of the chamber 2 and is closed during steaming and open to the atmosphere during the drying cycle. The outlet 29 is automatically actuated by a mechanical or electric actuator so that the outlet 29 is opened at the beginning of the drying process.

Therefore, warm air enters the chamber 2 at the bottom, passes the garments 4 and dries them by evaporating and carrying away the water through the air outlet 29. The speed of the drying process will depend on the power of the fan 25 and air heater 26 and also on the wetness of the garments 4. The drying process should provide air of a temperature above 50° C. for about 20 minutes. Drying the garments in this way prevents bacterial growth on wet or damp garments and means that the garments are more readily useable again.

Figure 3:
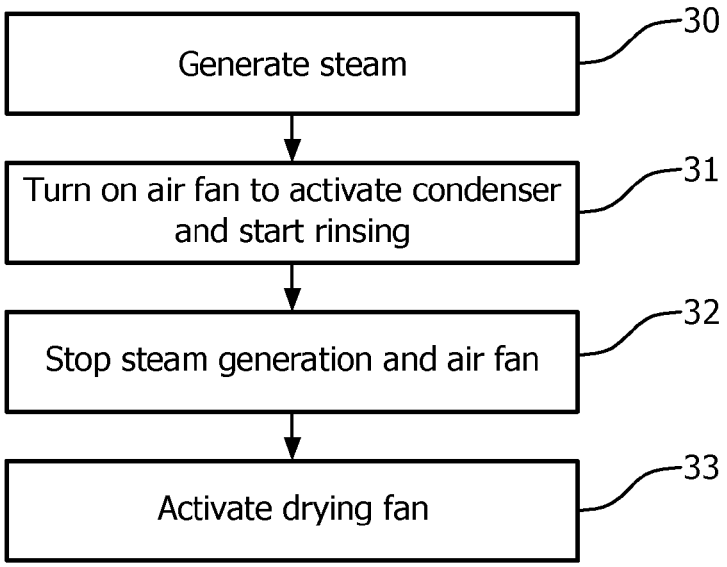
FIG. 3 shows a flow diagram for the cleaning process described with reference to FIGS. 1 and 2.

FIG. 3 shows a process flow diagram for the cleaning process described with reference to FIGS. 1 and 2. Prior to commencing the cleaning process the garments 4 should be hung in the chamber 2, the lid 5 should be fixed and the water tank 7 should be filled. Once ready, the cleaning process shown in FIG. 3 can commence as follows:

Generate steam 30. Water from the water tank 7 is heated into steam, which is ionized and enters the chamber 2 to clean the garments 4.

Turn on air fan to activate condenser and start rinsing 31. Turning on the air fan 21 cools the condenser 9 which facilitates the rinsing process.

Stop heater and air fan 32. At the end of the cleaning cycle, the steam generator and air fan are turned off.

Activate drying fan 33. Turning on the air fan 25 and heater 26 to blow warm or hot air 24 through the chamber 2 dries the garments 4.

It is most effective if the steaming and rinsing processes 30, 31 occur at least partly simultaneously, for example the steaming process 30 may begin before the rinsing process 31 and they end at the same time. However, the rinsing process 31 could occur after the steaming process 30 so long as enough steam remains in the chamber 2 to condense and drip onto the garments 4.

Figure 4:
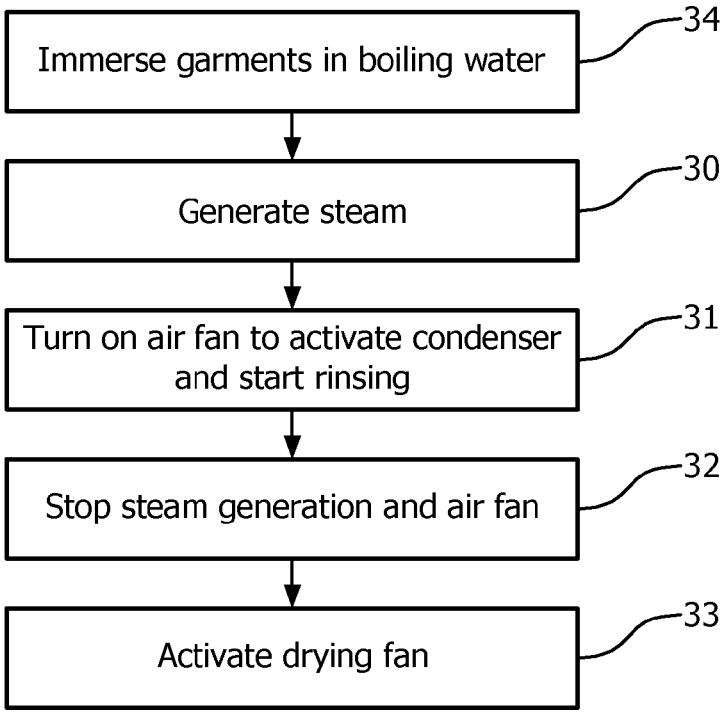
FIG. 4 shows a flow diagram for an alternative cleaning process.

FIG. 4 describes an alternative cleaning method with an additional cleaning step 34 before the steam cleaning 30 begins. The initial step is to immerse the garments in boiling or nearly boiling water 34, before commencing with the method described with reference to FIG. 3.

The garments 4 may be immersed in boiling or nearly boiling water at around 95° C. by flooding the chamber 2 of FIGS. 1 and 2 with boiling or nearly boiling water; the chamber 2 may be configured to be flooded with water, heated by a heater and then drained after a sufficient amount of time. Alternatively, the garments 4 may be lowered into a basin of boiling or nearly boiling water for a period of time and then lifted out of the basin. Following the boiling process 34, the steam cleaning and drying processes 30, 31, the same as described with reference to FIGS. 1, 2 and 3, can be implemented to further cleanse and dry the garments. The boiling process 34 is effective at removing stains and dirt; the steaming and rinsing processes 30, 31 are effective at removing detergent residues and ensuring that the garments are fully sanitised; the drying process 33 ensures that bacteria are not able to grow on wet or damp garments.

In alternative embodiments the step of immersing the garments into boiling or nearly boiling water may be replaced by immersing the garments in water of a lower temperature, especially when boiling or nearly boiling water could damage the garments. In alternative embodiments the user might select a temperature of the water for immersing the garment into. In other embodiments the type of garment is detected automatically and the temperature of the water adjusted to obtain an optimal setting.

The cleaning processes described with reference to FIGS. 1 to 4 can be implemented with a program control system. A simple program controller comprising a timer, mechanical or electrical, can be used to control the steam generator, the cooling air fan and the drying cycle. A user may be able to adjust certain parameters of the cycle to suit different garments, such as more delicate fabrics requiring less steam or heavier items needing a longer drying cycle. The user may be able to adjust these parameters individually or choose from a set of pre-programmed cycles. One of the pre-programmed cycles may be a self-cleaning cycle, where the device implements a cleaning cycle designed to clean the chamber and other components without garments being in the chamber. The self-cleaning cycle may also include an operation to drain residual water from the chamber and steam generator after the appliance has been used for a predetermined period of time or number of cleaning cycles.

It should be noted that the above-mentioned embodiments illustrate rather than limit the invention, and that those skilled in the art will be able to design many alternative embodiments without departing from the scope of the appended claims. It will be appreciated that the term "comprising" does not exclude other elements or steps and that the indefinite article "a" or "an" does not exclude a plurality. The mere fact that certain measures are recited in mutually different dependent claims does not indicate that a combination of these measures cannot be used to an advantage. Any reference signs in the claims should not be construed as limiting the scope of the claims.

Although claims have been formulated in this application to particular combinations of features, it should be understood that the scope of the disclosure of the present invention also includes any novel features or any novel combinations of features disclosed herein either explicitly or implicitly or any generalisation thereof, whether or not it relates to the same invention as presently claimed in any claim and whether or not it mitigates any or all of the same technical problems as does the parent invention. The applicants hereby give notice that new claims may be formulated to such features and/or combinations of features during the prosecution of the present application or of any further application derived therefrom.

The invention claim is:

1. A garment cleaning appliance comprising:

a housing having a chamber to receive garments to be cleaned;

a steam generator for supplying steam into the chamber to clean garments in the chamber; and rinsing means arranged within the chamber to direct a steady stream of rinse water, condensed from steam alone, onto garments received in the chamber to rinse the garments via the steady stream of rinse water condensed from steam alone, with no additional water feed, supply or pump to provide or move rinse water to a top of the chamber, wherein the rinsing means comprises a condensing element that includes a (i) a lower surface that faces the garments and is exposed to steam in the chamber and (ii) an upper surface not exposed to steam in the chamber, the condensing element further having a W-shape cross-section and a surface area that covers a majority of a surface area at the top of the chamber, the condensing element being arranged to condense the steam at the top of the chamber on the lower surface of the condensing element into condensate and further being arranged with lower points of the W-shape cross-section positioned immediately above garment supports in the chamber to direct, via the W-shape cross-section of the lower surface, the condensate as a steady stream of rinse water onto the garments under influence of gravity.

2. A garment cleaning appliance according to claim 1, wherein the steam generator is positioned at one selected from the group consisting of (i) beneath the chamber such that steam is ejected into the chamber below garments in the chamber and (ii) at a lower portion of the chamber such that steam is ejected into the chamber at a lower portion of the garments in the chamber.

3. A garment cleaning appliance according to claim 2, wherein the steam generator comprises a water tank arranged to receive water and a heater to heat the water in the water tank to generate steam.

4. A garment cleaning appliance according to claim 1, further comprising an ionizer, wherein the steam generated by the steam generator is ionized by the ionizer before entering the chamber.

5. A garment cleaning appliance according to claim 1, wherein the condensing element further comprises a metallic plate, wherein the metallic plate includes one surface that faces garments received in the chamber and is exposed to steam in the chamber, the other surface being exposed to a cool fluid wherein the steam condenses on the metallic plate and condensate is directed onto the garments in the chamber.

6. A garment cleaning appliance according to claim 5, further comprising a fan configured during a rinse cycle to blow air over said other surface of the metallic plate to expose said other surface to cool air.

7. A garment cleaning appliance according to claim 6, wherein the fan is located below or aside the chamber and the housing further includes a duct for passage of air blown from the fan to the other surface of the metallic plate.

8. A garment cleaning appliance according to claim 7, wherein the fan is further configured during a drying cycle to blow air over a heater and into the chamber to dry garments in the chamber.

9. A garment cleaning appliance according to claim 8, wherein the chamber further includes an inlet for passage of heated air into the chamber during the drying cycle and an outlet for the heated air that has passed through the chamber during the drying cycle.

10. A garment cleaning appliance according to claim 1, further comprising garment supports in the chamber to hang garments from or attach garments to said garment supports in the chamber.

11. A garment cleaning appliance according to claim 1, further comprising a water feed and a heater for flooding the chamber with hot water, prior to or after cleaning garments with steam.

* * * * *